US005272839A

United States Patent [19]

Karhu

[11] Patent Number: 5,272,839

[45] Date of Patent: Dec. 28, 1993

[54] PIVOTABLE BALCONY GLAZING STRUCTURE

[75] Inventor: Niilo Karhu, Vantaa, Finland

[73] Assignee: Nikai Innovaatio Oy, Vantaa, Finland

[21] Appl. No.: 768,766

[22] PCT Filed: Mar. 28, 1990

[86] PCT No.: PCT/FI90/00083

§ 371 Date: Dec. 4, 1991

§ 102(e) Date: Dec. 4, 1991

[87] PCT Pub. No.: WO90/12183

PCT Pub. Date: Oct. 18, 1990

[30] Foreign Application Priority Data

Apr. 7, 1989 [FI] Finland ..... 891666

[51] Int. Cl.[5] ..... E05D 15/06

[52] U.S. Cl. ..... 49/409; 49/127; 49/410; 16/95 R

[58] Field of Search ..... 49/125, 127, 128, 177, 49/409, 410, 404, 176; 16/95 R

[56] References Cited

U.S. PATENT DOCUMENTS

| | | | |
|---|---|---|---|
| 3,052,000 | 9/1962 | Ferrett | 49/127 X |
| 3,750,334 | 8/1973 | Slaybaugh | 49/177 |
| 4,438,594 | 3/1984 | Bunzl | 49/125 X |
| 4,476,652 | 10/1984 | Beauchot | 49/410 X |
| 4,651,469 | 3/1987 | Ngian et al. | 49/409 X |
| 4,991,257 | 2/1991 | Euterach | 49/409 X |
| 5,022,454 | 6/1991 | Kobayashi et al. | 49/125 X |
| 5,058,321 | 10/1991 | Harbom et al. | 49/177 |

*Primary Examiner*—Peter M. Cuomo
*Assistant Examiner*—Jerry Redman
*Attorney, Agent, or Firm*—Morgan & Finnegan

[57] ABSTRACT

A pivotable glazing structure for covering an opening comprising sheets forming sections. Each sheet having a bottom edge and a top edge and each sheet is supported by its tip or bottom edge to a first bearing rail mounted on a structure and an opposite edge is supported at one supporting point to a second bearing rail mounted on a structure. The sheets can be individually moved to an edge of the opening covered by the sheets on sheet supporting points and pivoted through 90 degrees on first sheet hinge pines which are positioned at supporting points in alignment with each other so as to expose an outwardfacing surface of the sheet. A second hinge pin of the sheet is provided with a latch for locking the second hinge pin in position as the sheet is being pivoted on hinge pins. The latch comprises a jutting member made of a flexible material and the jutting member is adapted to engage with a toothed portion attached to or formed integrally with the bearing rail.

13 Claims, 7 Drawing Sheets

FIG. 7
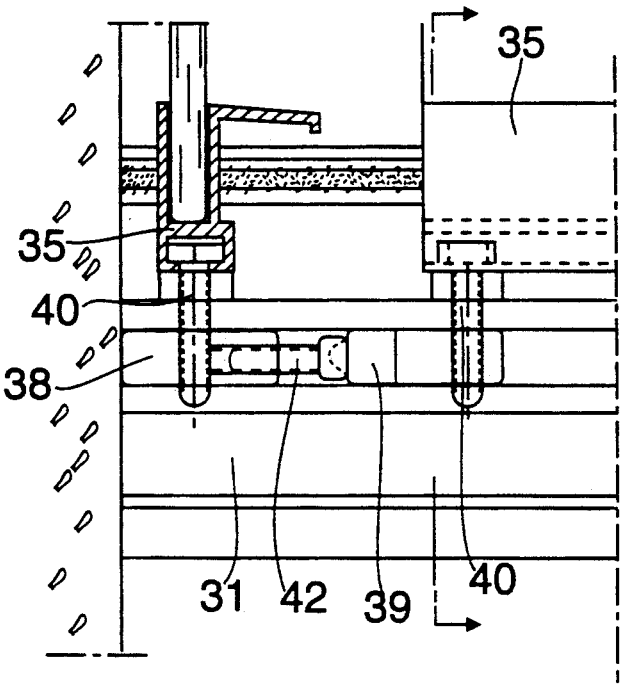
FIG. 8
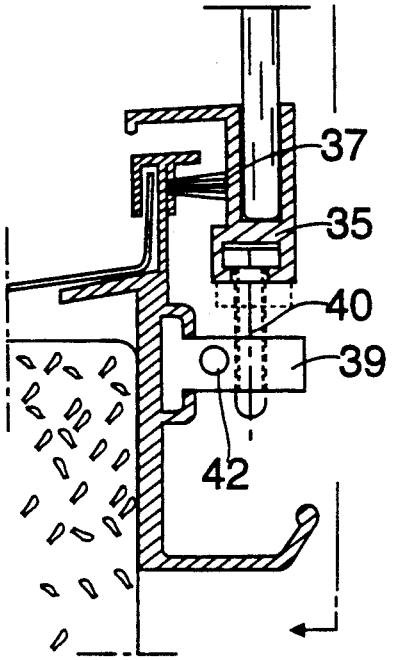
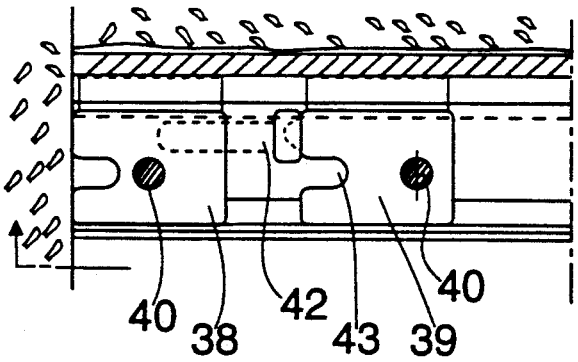
FIG. 9
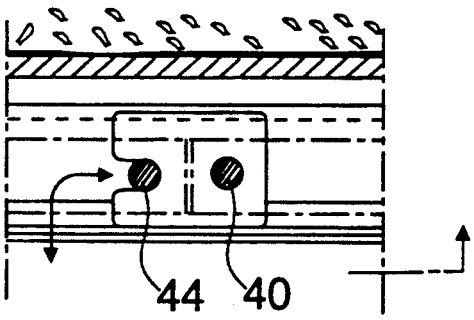
FIG. 10

PIVOTABLE BALCONY GLAZING STRUCTURE

The present invention relates to a pivotable balcony glazing structure or a similar wall-like covering formed by sheet-like sections, wherein each sheet is suspended by its top or bottom edge, preferably at two points, to a bearing rail secured to a balcony structure or a like and the opposite edge of a sheet is supported by one point on a second bearing rail secured to a balcony structure or a like, whereby the sheets can be carried one by one upon their points of support to the edge of an opening covered by the sheets and pivoted there upon the sheet hinge pins fitted in the points of support aligned with each other at the top and bottom edge of a sheet for example through 90° so as to expose the outward-facing surface of a sheet.

The glazings for apartment house balconies have become more and more popular over the recent years. The traditional glazing type is such that the open side of a balcony is covered with sashed glass panes sliding upon rails mounted on the top and bottom edge, said panes overlapping in lateral direction. A drawback in this solution is that the glazing cannot be fully opened, which would be desirable e.g. on a hot day. Secondly, washing of their outward-facing surfaces is difficult and dangerous. In addition, the sash-fitted panes impair the appearance of a facade. Due to the above drawbacks, such glazings have not been accepted in quite a few cities.

Another prior known glazing type is the one wherein the panes can be pivoted adjacent to the side wall of a balcony about a vertical axis to lie inside a balcony. This is accomplished by means of a double-rail, the inner one turning at the edge of a balcony to form a special pivoting rail which is mounted on the ceiling of a balcony. The panes are sliding upon two trolleys which are mounted on the top edge and journalled upon vertical axles in the top pane corners. When the trolley running on the inner rail reaches the pivoting rail, the corresponding edge of a pane swings inside a balcony. Thus, the pivoting occurs on three points, i.e. upon trolleys on the top edge and a single slider on the bottom edge.

The main drawbacks in this type of glazing are as follows:

due to the constructional reasons, a 1-wheel trolley pivotable on a vertical axle produces friction between the wheel and the rail which may lead to excessive wear.

Mounting of the pivoting rail requires exact precision since even a slight deviation of height can cause friction between the wheels and the rail, thus hampering the pivoting movement of the panes.

A pivoting rail fitted to the ceiling of a balcony is aesthetically undesirable.

The pivoting-railed structure restricts the width of a pane to circa 650 mm since the handling of wider panes becomes inconvenient.

In an effort to eliminate these drawbacks a structure of the invention is designed in a manner that one of the hinge pins of a sheet, preferably the top edge hinge pin, is fitted with a latch which immobilizes the hinge pin when the sheet is pivoted on the hinge pins.

In one preferred embodiment of the invention, the latch preferably comprises a bracket-like member which is made of a flexible material, preferably spring steel, and which is adapted to engage with a toothed portion mounted on the bearing rail or formed integrally therewith.

Another preferred embodiment of the invention is designed in a manner that the latch is adapted to rotate relative to the hinge pin through the intermediary of a spring to a latch locking position when a sheet is pivoted on the hinge pins.

A solution of the invention offers the following benefits over the prior art:

In a sliding position the carrier wheel is propped to extend parallel to the rail to thus eliminate the friction between wheel and rail.

The 90° rotation of a pane is effected upon two points, i.e. upon axle stubs fitted to the top and bottom corner of a pane the same way as hinges, so a possible inexact fitting does not affect the pivoting movement.

A structure of the invention does not require aesthetically undesired parts jutting out of the side rail.

By virtue of the pivoting mechanism the width of a pane be circa 800 mm without the handling being hampered. Manufacturing and fitting costs will be reduced.

The invention will now be described in more detail by way of an example with reference made to the accompanying drawings, in which:

FIGS. 7–9 illustrate a hinged bottom corner in a glazing structure of the invention.

FIG. 10 shows a glazing structure of the invention in a section according to FIG. 9 with two adjacent panes following each other.

Figure 1:
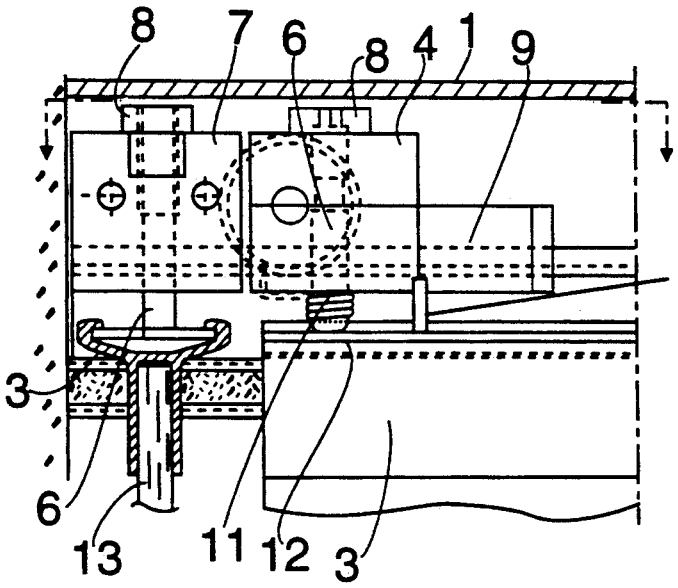
FIGS. 1–3 illustrate a hinged top corner in a glazing structure of the invention.
Figure 2:
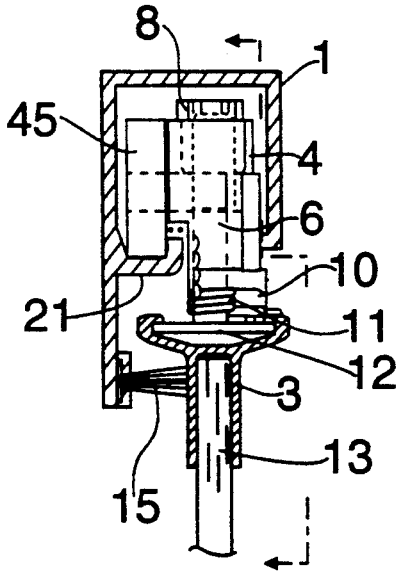
Figure 3:
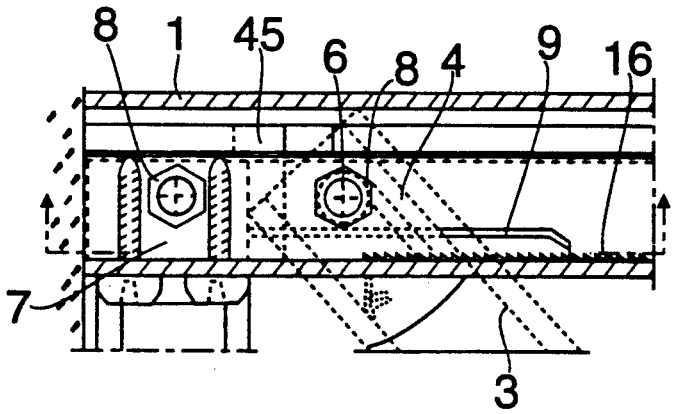

In a pivotable balcony glazing of the invention (FIG. and 16), a necessary number of laterally sliding glass panes 13 are suspended by means of wheels 45, 46 at the top edge of each pane from a top rail 1 fixed to a balcony structure. A bottom rail 31 steers the bottom end of a pane during its sliding pivoting. A pane of similar construction as the others at one or both ends of a glazing is usually fixed in position so as to be laterally immobile.

When opening the glazing, the first pane is pivoted or folded relative to the top and bottom rails upon its fixed hinges through 90° to lie against the side wall of a balcony. This is followed by sliding the following pane adjacent to the first one, whereafter it is pivoted relative to a vertical axis, as described hereinafter in more detail, to lie on top of the previously folded pane, followed by sliding the next pane adjacent to the latest folded one and pivoting it relative to a vertical axis to lie on top of that etc. until all the panes are pivoted or folded. Pivoting of the pane is effected upon two points, i.e. an axle stub 6 journalled in a bracket structure 4 of wheel 45 and an axle stub 40 fixed to a bottom corner of the pane and fitted in a hole made in a slider 39 mounted on lower slide rail 31.

In order to make it possible to pivot a pane, the pivoting axle of a pane must be locked in position and, on the other hand, a wheel 46 carried by upper rail at the in-turning end of a pane must be brought out of the upper rail. This can be done in the following fashion.

Figure 11:
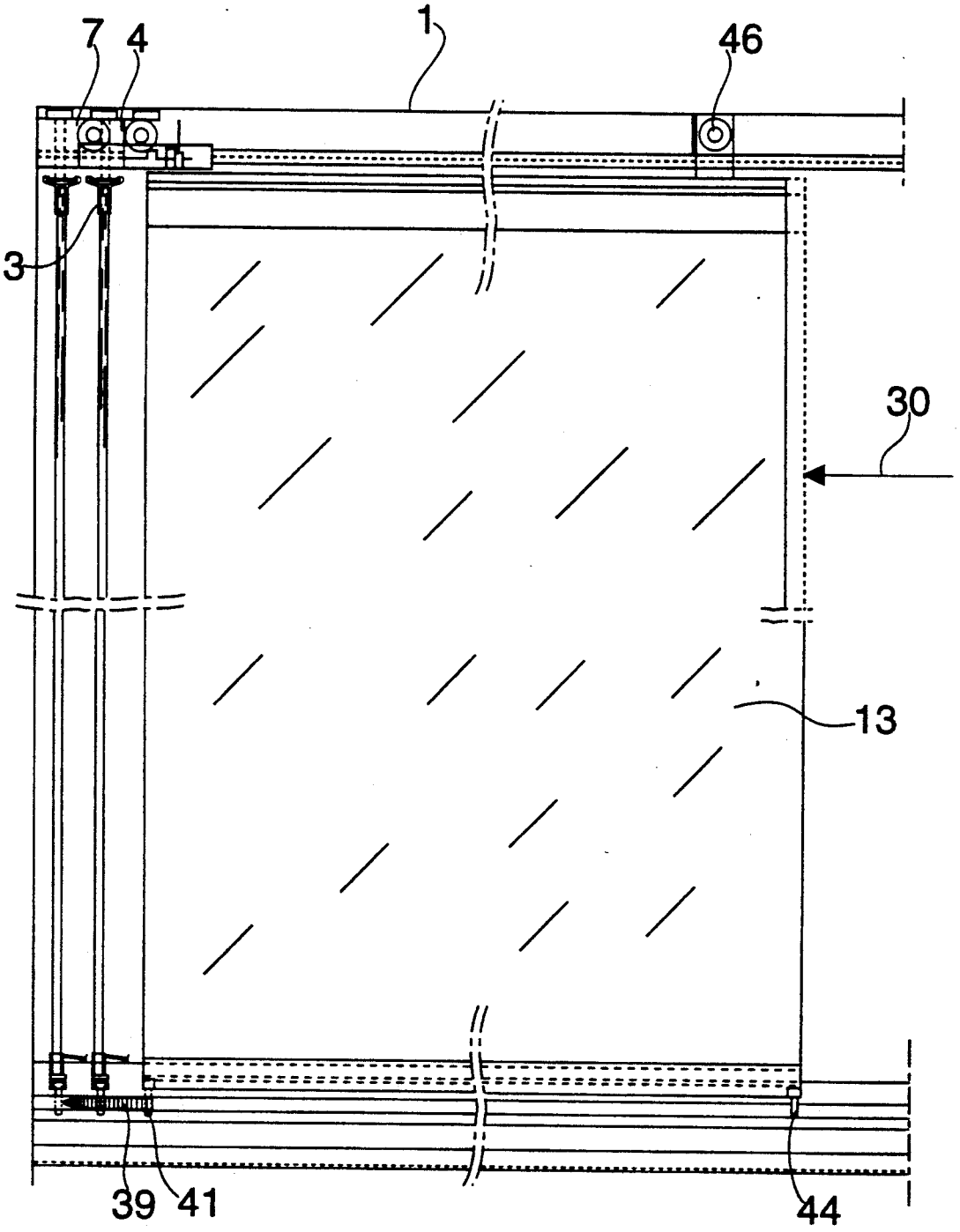
FIG. 11 is a schematic frontal view of a glazing structure of the invention.
Figure 15:
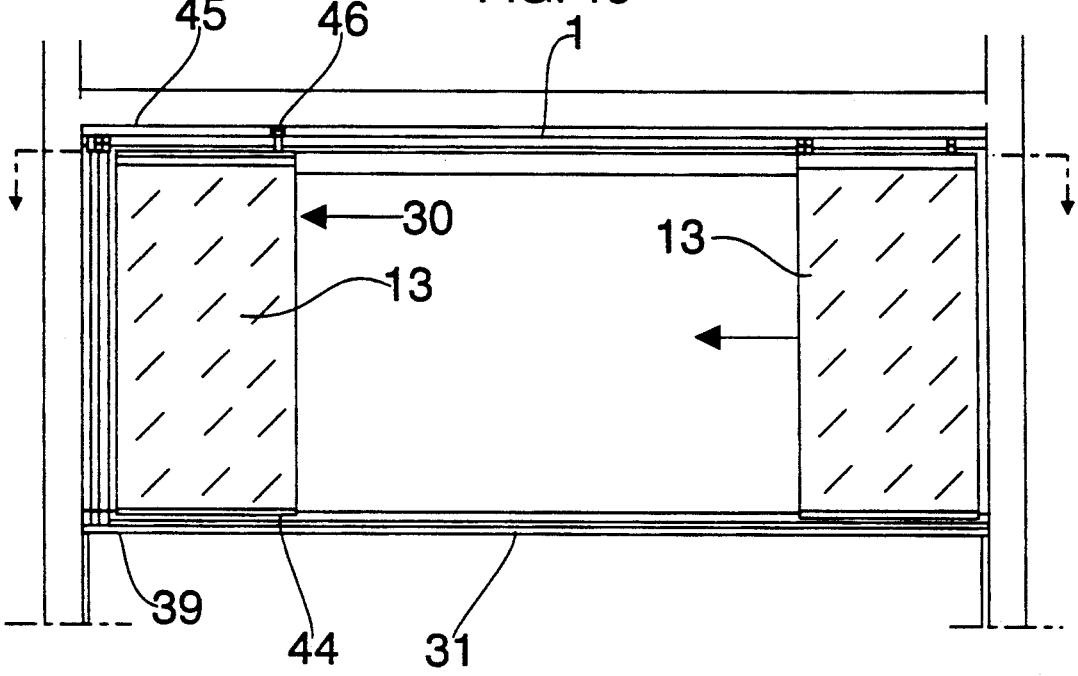
FIGS. 15 and 16 are schematic frontal and plan views, respectively, of a glazing structure of the invention.
Figure 16:
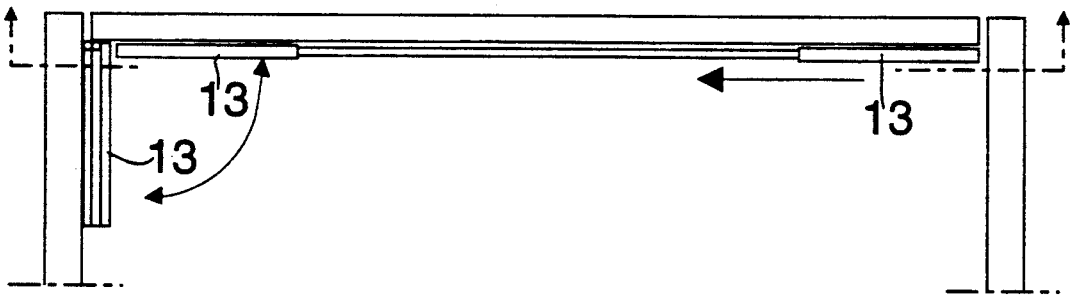

When a first freely sliding pane 13 is slid adjacent to a pane turned through 90 ° on fixed hinges to lie against the side wall of a balcony, a slider 39 mounted on lower rail 31 meets a stop screw 42. When the rear edge of a pane is pressed from its upper portion with a certain force 30, as shown in FIGS. 11 and 15, a pane 13 is tilted and a bracket structure 4 of wheel 45 touches an upper hinge body 7 of the fixedly hinged pane. Thus, a wheel 46 comes up out of a trough 21 Of upper rail 1. At the following pane said stop screw 42 is not needed as the pivoted pane is already inclined at an angle set by stop screw 42.

Figure 4:
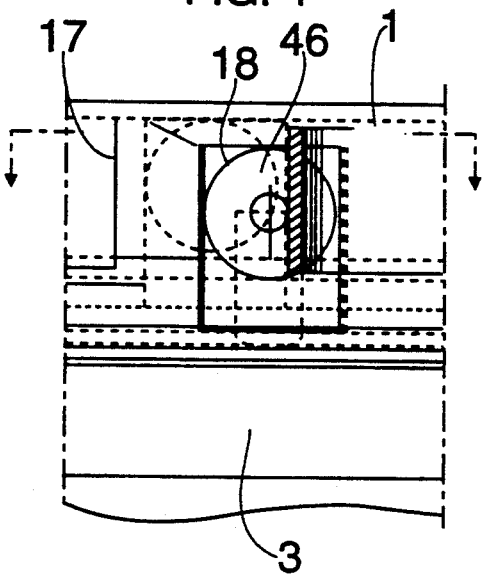
FIGS. 4–6 illustrate an in-pivotable top corner in a glazing structure of the invention.
Figure 5:
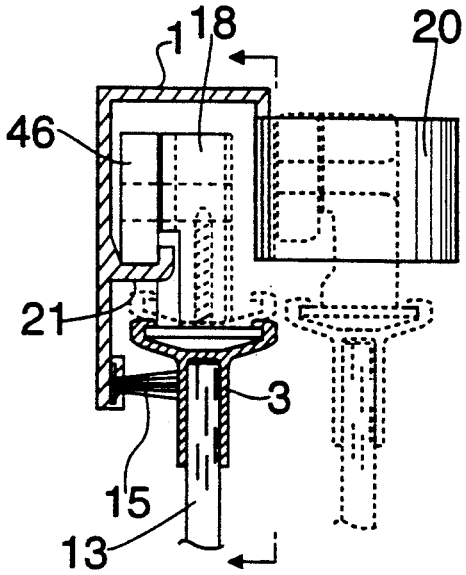
Figure 6:
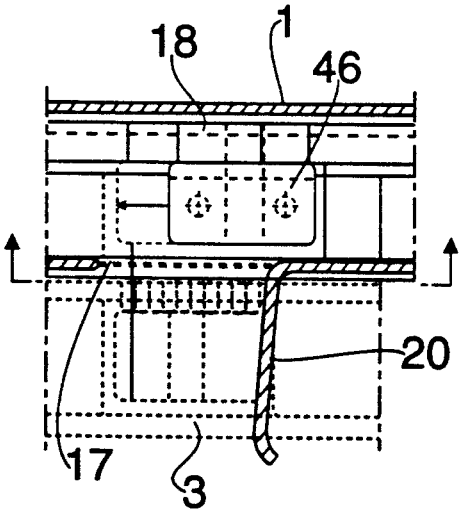

FIGS. 4–6 illustrate an opening 17 which is machined in upper rail 1 and does not allow wheel 46 out of the rail as the pane is pivoted. The edge of trough 21 can be formed with a notch for turning the wheel aside but, in view of a smooth operation, it is preferred that the wheel rises up more or less prior to pivoting the pane. The opening 17 is provided with a wing-shape bracket 20 which prevents the backward tilting of a pane at this stage.

It should be noted that the position of wheel 46 varies in various panes in order to turn wheel 46 through one and the same opening 17.

Figure 17:
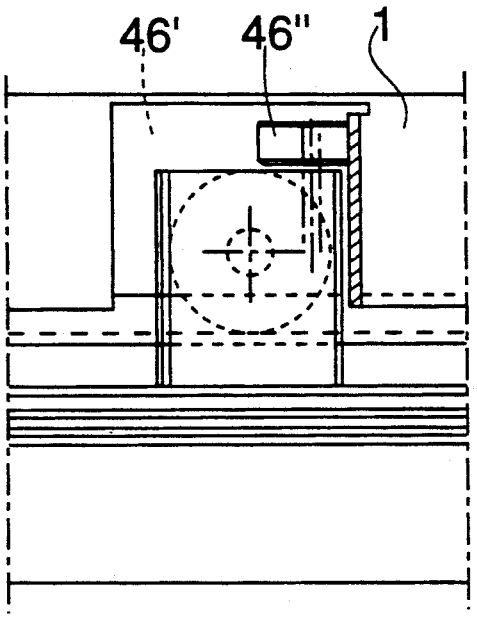
FIGS. 17–19 illustrate an in-pivotable top corner in a glazing structure of the invention in an alternative embodiment.
Figure 18:
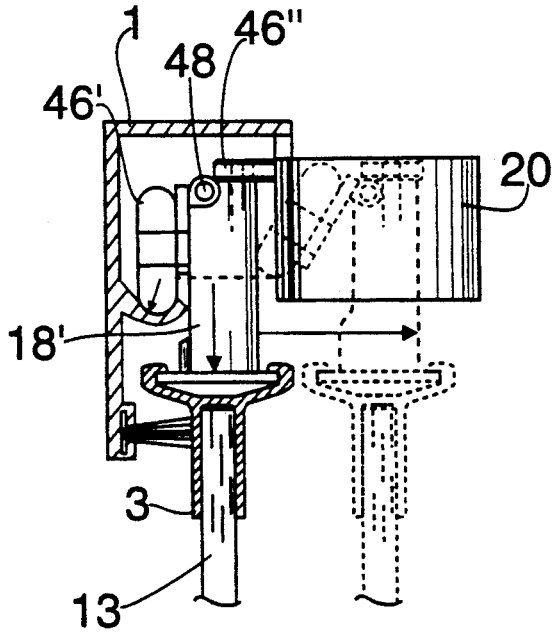
Figure 19:
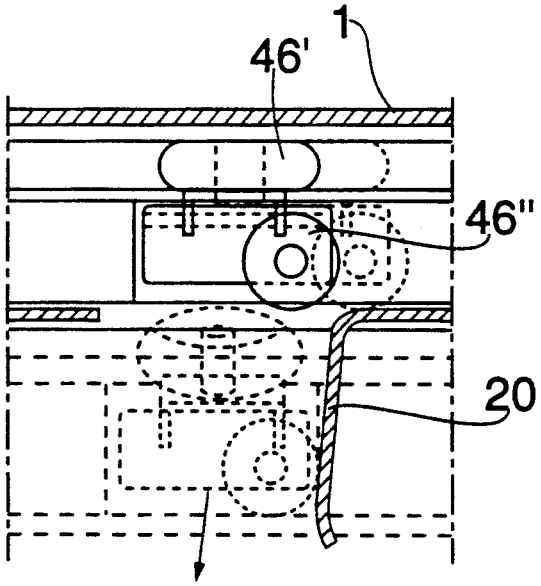

FIGS. 17–18 illustrate an alternative design to replace the wheel structure shown in FIGS. 4–6. This design is such that a bracket structure 18' fixed supported relative to a sheet 13 is provided with two wheels 46', 46'', one 46'' being journalled to bracket structure 18' by means of a vertical axle. Said axle serves at the same as the rotating axle for wheel 46''. The horizontal rotating axle of the other wheel 46'' is tiltably supported through the intermediary of an axle 48, supported on the bracket structure and extending parallel to bearing rail 1. Wheel 46'' leans continuously on the inner surface of bearing rail 1 and, thus, when opening a pane 13, also against a bracket 20, whereby the pane can be readily pulled in while the vertically supporting wheel 46' is tilting simultaneously, possibly assisted by the action of a spring (not shown).

The bracket structure 4 of wheel 45 is journalled relative to pane 13 so as to pivot in horizontal direction around a pin 6, as pointed out hereinbefore. The pin 6 comprises a screw provided with a large-size head 12 and is fixed by its head 12 to the upper jamb 3 of pane 13. The threaded upper end of pin 6 is inside an internally threaded sleeve 8 and the base portion of sleeve 8 is designed to be turned with a wrench, preferably as a hexagonal base, for adjusting the vertical position of pane 13 at opening 17.

Figure 12:
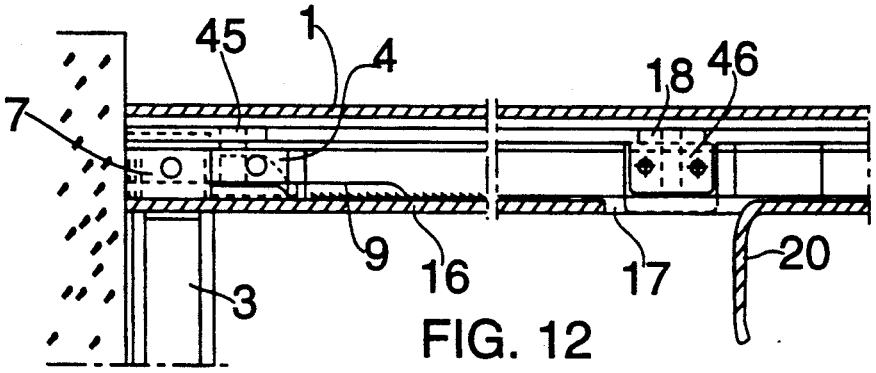
FIG. 12–14 show the locking sequences for a latch in a glazing structure of the invention.
Figure 13:
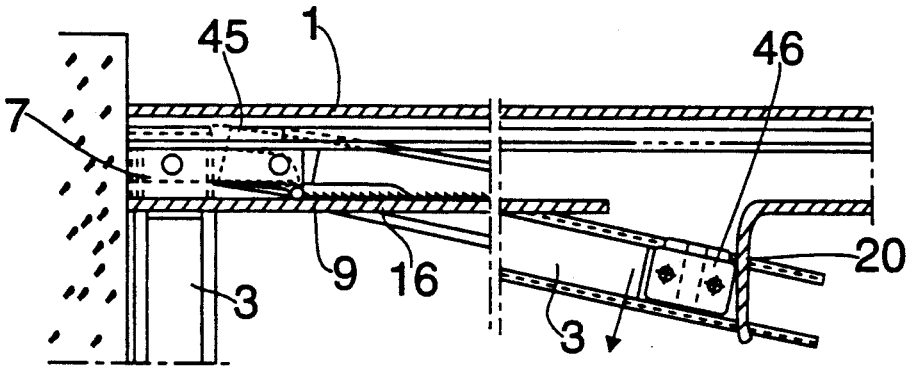
Figure 14:
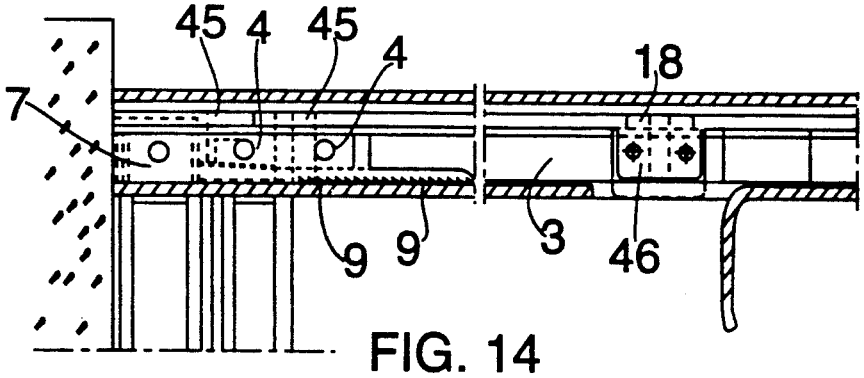

The side surface of bracket structure 4 is fitted with a tongue-like latch 9. Around said pin 6 is coiled a spring 11 which is fixed by one of its ends to bracket structure 4 and by its other end leans against a limiter pin 10 mounted on upper jamb 3, said spring maintaining the bracket structure of wheel 45 in parallel relationship with the pane and upper rail 1 whenever wheel 46 is inside the upper rail and the pane is in a sliding position but, as the bracket structure 18 of wheel 46 comes out of upper rail 1 within the range allowed by a limiter 20, said pane 13 and its upper jamb 3 as well as bracket structure 4 of wheel 45 are pivoted to the extent that the free end of latch 9 is pressed into a toothed rack 16 mounted on the edge of upper rail 1 to prevent the backward tilting of the pane. As pane 13 is pivoted further, said bracket structure 18 of wheel 46 moves out of alignment with limiter 20 but spring 11 makes sure that said latch 9 remains locked in toothed rack 16 and said bracket structure 4 of wheel 45 operates the same way as a fixed hinge. Thus, each pane can be pivoted in its turn through 90 to lie adjacent to the side wall of a balcony (FIGS. 12, 13, 14).

The bottom edge of each pane 13 is provided with a jamb 35 which carries downwards directed pins 40, 44 at both ends. The lower slide rail 31 is provided with a groove to accommodate sliders 38, 39 which differ from each other only in the sense that slider 38 is locked fixedly in position. A pin 40 mounted on the pivoting edge of each pane 13 fits in a hole made in slider 38, 39 for building a sliding and/or pivoting hinge steering one of the bottom corners of a pane.

A pin 44 mounted on the in-turning bottom corner of a pane fits in a notch 43 made in slider 39 for locking said bottom pane corner in position as the edges of the panes are pushed against each other for closing the glazing.

When closing the glazing, each pane 13 is pivoted in turn back through 90°, i.e. to lie parallel to the rails. Thus, said pin 10 releases latch 9 from toothed rack 16 and wheel 46 drops into the upper rail groove 21 and the pane is able to slide back to a closed position.

Latch 9 can be made e.g. of spring steel whereby it deflects and the weight of a pane keeps it locked on toothed rack 16 until a certain force 30 is appled to the edge of a pane to release the latch. This serves to avoid jolting movements.

The panes are preferably manufactured of tempered glass. The glazing can be designed to be assembled at one or both ends of a balcony.

The vertical edges of the panes are either without jambs or jambed and unsealed or provided with a sealing.

Sealings 15, 37 at the top and bottom edge are prior known brush or e.g. silicone sealings and their disposition can be different from what is shown in the figures.

I claim:

1. A pivotable glazing structure or covering an opening comprising sheets forming sections, each section having a bottom edge and a top edge and each sheet is supported by its top or bottom edge to a first bearing rail (1) mounted on a structure and an opposite edge is supported at one supporting point (39) to a second bearing rail (31) mounted on a structure, wherein the sheets can be individually moved to an edge of the opening covered by the sheets on sheet supporting points (45, 46, 40) and pivoted through 90° on first sheet hinge pins (40) which are positioned at supporting points (45, 40) in alignment with each other so as to expose an outwardfacing surface of the sheet (13), wherein a second hinge pin (6) of sheet (13) is provided with a latch (9) for locking said second hinge pin (6) in position as said sheet (13) is being pivoted on hinge pins (6, 40), said latch comprises a jutting member made of a flexible material and said jutting member is adapted to engage with a toothed portion (16) attached to or formed integrally with the bearing rail.

2. A structure as set forth in claim 1, wherein when an outermost sheet of sheets (13) is in an in-turned position, a lower portion thereof, preferably a bracket (39) supporting a hinge pin (40), is provided with an extension (42), suitably an adjustable extension against which an adjacent sheet or, preferably the bracket of the adjacent sheet (39) of its hinge pin (40), first collides as said sheet (12) is moving upon rails (1, 31) towards the outermost sheet.

3. A structure as set forth in claim 2, wherein the adjustable extension is a screw.

4. A structure as set forth in claim 1, wherein a guide extension (20) projects from said bearing rail (1) in a sheet pivoting direction which is adapted to prevent the tilting of said sheet (12) before said latch (9) locks hinge pin (6) in position on rail (1) and prevents the tilting of the sheet.

5. A structure as set forth in claim 1, wherein said latch (9) is adapted to rotate relative to hinge pin (6) through the action of a spring (11) to a latch locking position as said sheet (12) is being pivoted upon hinge pins (6, 40).

6. A structure as set forth in claim 1, wherein said first bearing rail (1) is provided with an opening (17) adjacent to guide extension (20) for bringing supporting point (46) out of the rail.

7. A structure as set forth in claim 1, wherein said supporting point (46) to be brought out of bearing rail (1 through opening (17) is designed to be adjustable in the direction of the edge of said sheet (13).

8. A structure as set forth in claim 1, wherein an upper edge of the sheet is fitted with two carrier wheels (45, 46), a bracket structure (18) of one of said wheels being fixedly mounted and a bracket structure (4) of the other of said wheels being rotatably mounted relative to said sheet (13), and that a lower edge of said sheet (13) is provided with a fixed, downward-directed pin (40) which is rotatably mounted on bearing rail (31) by means of a slider (39).

9. A structure as set forth in claim 1, wherein a lower edge of said sheet (13) is further provided with a second fixed downward-directed pin (44) which, in a closed position of the structure, is adapted to brace itself in a notch (43) made in slider (39) of an adjacent sheet.

10. A structure as set forth in claim 1, wherein a bracket structure (18') fixedly supported relative to said sheet 913) is provided with two wheels (46', 46''), one wheel (46'') being journalled to bracket structure (18') by means of a vertical axile, which axle serves at the same time as a wheel rotating axle, and a horizontal rotating axle of the other wheel (46') being tiltably supported through the intermediary of an axle (48) mounted on the bracket structure and extending in a direction of the bearing rail.

11. A structure as set forth in claim 1, wherein each sheet is supported at two points (45, 46) to the bearing rail (1).

12. A structure as set forth in claim 1, wherein a top edge hinge pin is provided with a latch (9).

13. A structure as set forth in claim 1, wherein the jutting member is made of spring steel.

* * * * *